US007138744B2

(12) United States Patent
Niimi et al.

(10) Patent No.: US 7,138,744 B2
(45) Date of Patent: Nov. 21, 2006

(54) BRUSH OF ROTARY ELECTRIC MACHINE

(75) Inventors: Masami Niimi, Handa (JP); Takashi Hirabayashi, Chita-gun (JP)

(73) Assignee: Denso Corporation, Kariya (JP)

( * ) Notice: Subject to any disclaimer, the term of this patent is extended or adjusted under 35 U.S.C. 154(b) by 20 days.

(21) Appl. No.: 11/060,708

(22) Filed: Feb. 18, 2005

(65) Prior Publication Data

US 2005/0212376 A1 Sep. 29, 2005

(30) Foreign Application Priority Data

Mar. 29, 2004 (JP) ..... 2004-096040

(51) Int. Cl.
*H01R 39/20* (2006.01)
*H01R 39/22* (2006.01)

(52) U.S. Cl. ..... 310/251; 310/252

(58) Field of Classification Search ..... 310/251–253
See application file for complete search history.

(56) References Cited

U.S. PATENT DOCUMENTS 1,117,965 A * 11/1914 Becker ..... 310/248
1,556,990 A * 10/1925 Henry ..... 252/511
2,613,239 A * 10/1952 Lundy ..... 310/251
3,274,304 A * 9/1966 Horton et al. ..... 264/434
3,821,024 A * 6/1974 Wilkin ..... 428/634
4,000,430 A * 12/1976 Bely et al. ..... 310/251
5,387,831 A * 2/1995 Yang ..... 310/242
6,528,923 B1 3/2003 Katoh et al.
6,815,862 B1 * 11/2004 Inukai et al. ..... 310/251

FOREIGN PATENT DOCUMENTS

JP 6-233498 * 8/1994
JP 2002-176750 6/2002

* cited by examiner

*Primary Examiner*—Burton Mullins
(74) *Attorney, Agent, or Firm*—Oliff & Berridge, PLC

(57) ABSTRACT

A brush to be disposed on a commutator of a dc rotary electric machine includes a high resistance member to be positioned at a front side of the commutator in the rotation direction, a low resistance member to be positioned at a back side in the rotation direction of the commutator, a medium resistance member disposed between the high resistance member and the low resistance member. The content of conductive material is arranged so that the low resistance member and the high resistance member have a difference ranging from 45% to 70%, and so that the medium provides a thermal expansion coefficient between the low resistance member and the high resistance member.

9 Claims, 4 Drawing Sheets

| | | | | | | | | |
|---|---|---|---|---|---|---|---|---|
| BRUSH OF PRIOR ART | HEAT SHOCK TEST | G | G | G | G | N | N | — |
| | MOLDING PROCESS | G | G | G | N | N | N | — |
| BRUSH OF FIRST EMBODIMENT | HEAT SHOCK TEST | G | G | G | G | G | G | N |
| | MOLDING PROCESS | G | G | G | G | G | G | N |
| LOW RESISTANCE | | 40 | 50 | 60 | 70 | 80 | 90 | 100 |
| HIGH RESISTANCE | | 20 | 20 | 20 | 20 | 20 | 20 | 20 |

BRUSH OF ROTARY ELECTRIC MACHINE

CROSS REFERENCE TO RELATED APPLICATION

The present application is based on and claims priority from Japanese Patent Application 2004-96040, filed Mar. 29, 2004, the contents of which are incorporated herein by reference.

BACKGROUND OF THE INVENTION

1. Field of the Invention

The present invention relates to a brush of a rotary electric machine such as a vehicle starter.

2. Description of the Related Art

Because it has been believed that the brush of a dc motor has to have a resistance specific to the output power of the motor, an extensive trial to reduce the resistance of the brush has not been made. For instance, a starter motor for a vehicle usually has a commutator and a pair of or a plurality of brushes made of a mixture of carbon powder and copper powder.

If the content of the copper powder is increased, the resistance of such brushes is reduced. However, the reduction in resistance may cause poorer performance of ac-to-dc conversion by the brushes and the commutator.

JP-A-2002-176750 or U.S. Pat. No. 6,528,923 B2, which is a counterpart of the former, discloses a stacked brush of a low resistance layer and a high resistance layer. The low resistance layer is effective to reduce the resistance of the brush, and the high resistance layer is effective to improve the ac-to-dc conversion or rectification. However, a substantial difference in mechanical characteristics between the two layers may increase as the difference in resistance between the two layers is increased. In this case, the brush may be broken during molding process of the brush or during operation of a motor having the brush, due to high temperature or vibration.

SUMMARY OF THE INVENTION

Therefore, an object of the invention is to provide an improved brush for a rotary electric machine, such as a starter motor for a vehicle.

Another object of the invention is to provide an improved brush that has a sufficiently high resistance member for ideal ac-dc conversion of the commutator and also a very low resistance member for increasing output power of an electric rotary machine.

According to a preferred feature of the invention, a brush to be disposed on a commutator of a dc rotary electric machine includes a high resistance member to be positioned at a front side of the commutator in the rotation direction of the commutator, a low resistance member to be positioned at a back side in the rotation direction; a medium resistance member disposed between the high resistance member and the low resistance member. In the above commutator, a difference in content of conductive material between the low resistance member and the high resistance member is in a range from 45% to 70%, and the medium resistance member has a content of conductive material to provide a thermal expansion coefficient between those of the low resistance member and the high resistance member.

Therefore, the brush may not be broken during manufacturing or operation of a motor even under a condition of high temperature and/or severe vibration.

In such a brush the following expression may be given between the total circumferential width W of the brush, the circumferential width wa of the high resistance member, the circumferential width Sw of one commutator segment and the width δ of a gap between the commutator segments: $W \geq wa+Sw+2\cdot\delta$. Therefore, the low resistance member may not solely connect three segments, so that current flowing through the low resistance member can be limited. As a result, the life time of the brush can be kept long.

In the above featured brush, the low resistance member may include a higher content of lubrication material than the high resistance member. This is effective to increase the lubricity of the brush.

In the above feature, the following conditions may be preferably given between the circumferential width wa of the high resistance member, a circumferential width wb of the low resistance member and a circumferential width wc of the medium resistance member: wb>wa, wb>wc. With these conditions, the total resistance of the brush can be effectively reduced, so that the output power of the motor can be increased.

In the above feature, the medium resistance member preferably has a thermal expansion coefficient at a middle between the thermal expansion coefficients of the high resistance member and the low resistance member.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
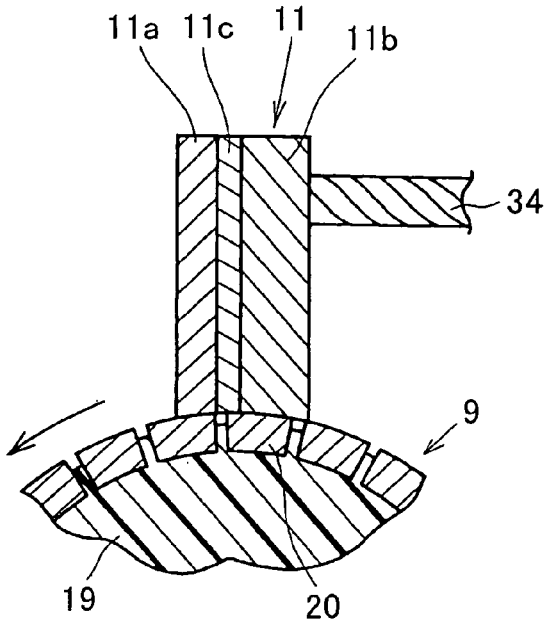
FIG. 1 is a fragmentary cross-sectional view of a brush according to the first embodiment of the invention on a commutator of a starter motor.

The present invention will be described with reference to the appended drawings.

A brush of a starter motor according to the first embodiment of the invention will be described with reference to FIGS. 1–6. As shown in FIG. 2, a starter 1 includes a dc starter motor 2, an output shaft 3 that is driven by the dc starter motor 2, a one-way clutch 4, a pinion gear 5, a shift lever 6, an electromagnetic switch 7, etc.

The starter motor 2 includes a field unit 8, a commutator 9, an armature 10, brushes 11, etc. When the electromagnetic switch 7 closes, current is supplied from a battery 12 to the armature 10, which generates torque. The field unit 8 includes a magnetic yoke 13, magnetic poles 14 fixed to the inner periphery of the magnetic yoke 13, and field coils 15 wound around the magnetic poles 14, etc. The field coil unit 8 may include permanent magnets instead of the field coils 15. The armature 10 includes an armature shaft 16, an armature core 17 carried by the armature shaft 16, armature coils 18 wound around the armature core 17, etc. The commutator 9 is fixed to a rear end (right end in FIG. 2) portion of the armature shaft 16. The commutator 9 includes a insulating member 19, a plurality of cylindrically disposed commutator segments 20, to which terminals of the armature coils 18 are electrically connected and mechanically fixed. The brushes 11 are disposed on the peripheral surface of the commutator 9 and biased by brush springs 21 against the peripheral surface of the commutator 9.

The output shaft 3 extends from the armature shaft 16 and is rotatably supported by a housing 23 via a bearing 22 at its front end. Incidentally, a speed reduction gear unit (not shown) may be disposed between the armature shaft 16 and the output shaft 3.

The one-way clutch 4 is connected to the output shaft 3 via a helical-shrine arrangement so as to transmit rotation of the output shaft 3 to the pinion gear 5 and to cut transmission of rotation of the pinion gear 5 to the output shaft when the pinion gear rotates at a speed higher than the output shaft 3.

The pinion gear 5 transmits the rotation of the starter motor 2 to a ring gear 24 of an engine. The pinion gear 5 is integrated with the clutch 4 to move together along the output shaft 3.

The shift lever 6 is supported by the housing 23 via a lever holder 28 so that it can swing. The lever 6 links its upper end to a hook 29 that is fixed to the plunger 27 and its lower end to an outside portion of the one-way clutch 4 to transmit the motion of the plunger 27 to the clutch 4.

Figure 2:
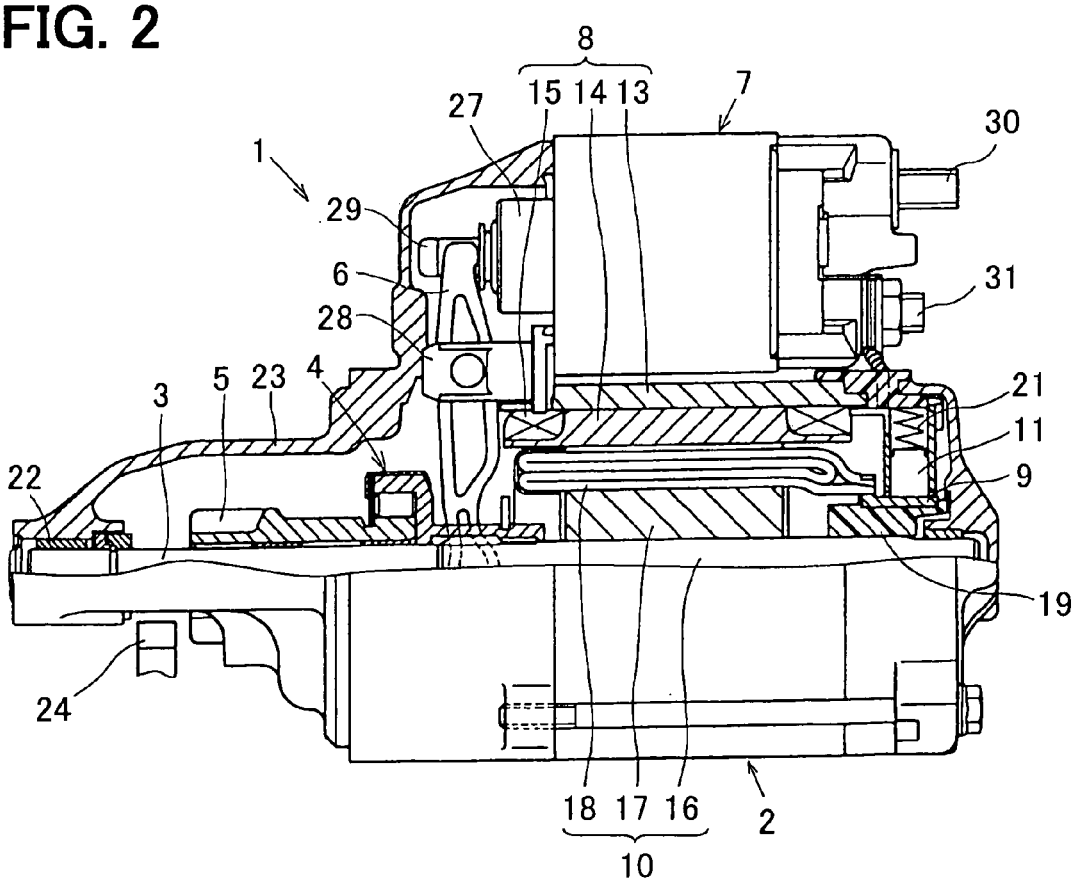
FIG. 2 is a partly cross-sectional side view of a starter that includes the starter motor and the brush shown in FIG. 1.
Figure 3:
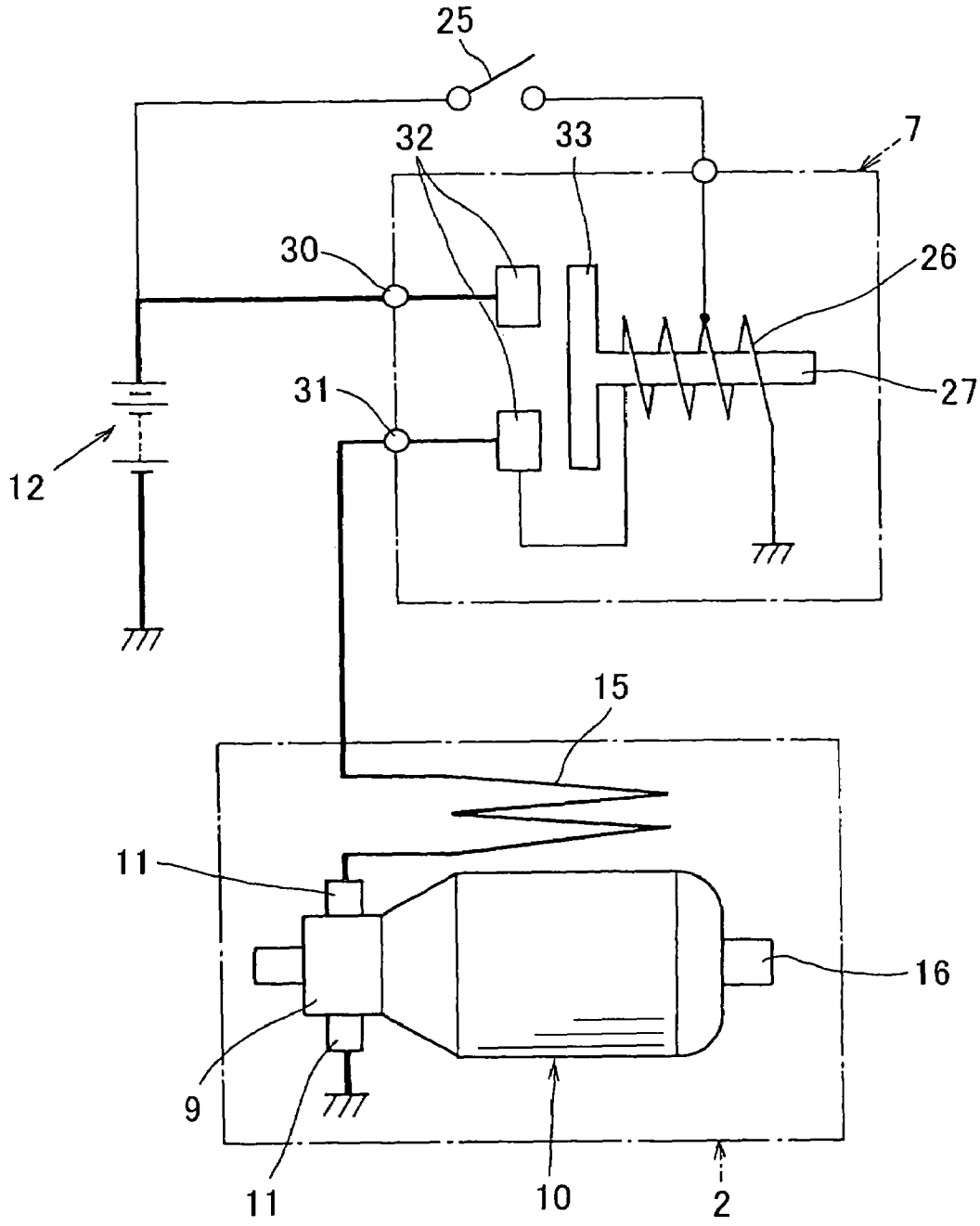
FIG. 3 is a schematic diagram illustrating the electrical circuit of the starter shown in FIG. 2.

As shown in FIG. 3, the electromagnetic switch 7 includes a solenoid 26, a plunger 27, a pair of stationary contacts 32, a movable contact 33, a return spring (not shown) etc. The stationary contacts 32 and the movable contact 33 form a main switch of the starter motor 2. When a starter switch 25 closes, current is supplied from the battery 12 to the solenoid 26, which pull the plunger 27 to the right in FIG. 2. On the other hand, the plunger 27 is retracted by the return spring when the starter switch 25 opens.

As shown in FIG. 1, the brush 11 is a composite brush of a high resistance member 11*a*, a low resistance member 11*b* and a medium resistance member 11*c* disposed between the high resistance member 11*a* and the low resistance member 11*b*. The medium resistance member 11*c* has a twisted pigtail wire 34. The brush 11 is disposed on the commutator 9 so that the high resistance member 11*a* can be positioned at the front of the rotation direction of the commutator and so that the low resistance member 11*b* can be positioned at the back of the rotation direction.

The low resistance member 11*b* includes conductive metal such as cupper or silver at a content between 70% and 90%, and the high resistance member 11*a* includes the conductive metal at a content between 10% and 30%. There is a difference in content from 45% to 70% between the low resistance member 11*b* and the high resistance member 11*a*. The medium resistance member 11*c* includes the conductive metal at a content between 40% and 60%. Therefore, the medium resistance member 11*c* has a thermal expansion coefficient between the low resistance member 11*b* and the high resistance member 11*a*.

When the starter switch 25 is closed, the solenoid 26 of the electromagnetic switch 7 is excited to pull the plunger 27 against the spring force of the return spring. Consequently, the shift lever 6 swings to push the pinion gear 5 and the clutch 4 along the output shaft 3 leftward in FIG. 2, so that the pinion gear 5 hits the ring gear 24 and stops. On the other hand, the main switch, which is formed of stationary contacts 32 and the movable contact 33, is closed by the plunger 27, and starter current is supplied to the armature 10 from the battery 12 to rotate the output shaft 3. Accordingly, the pinion gear 5 rotates and engages the ring gear 24, which cranks the engine.

After the engine has started and the starter switch 25 is opened, current supply to the solenoid 26 is cut. Accordingly, the plunger 27 is retracted by the return spring, and the shift lever 6 brings back the pinion gear 5 to disengage from the ring gear 24. When the plunger 27 is retracted, current supply to the armature 10 is also cut, so that the armature 10 stops its rotation.

Figures 4, 5:
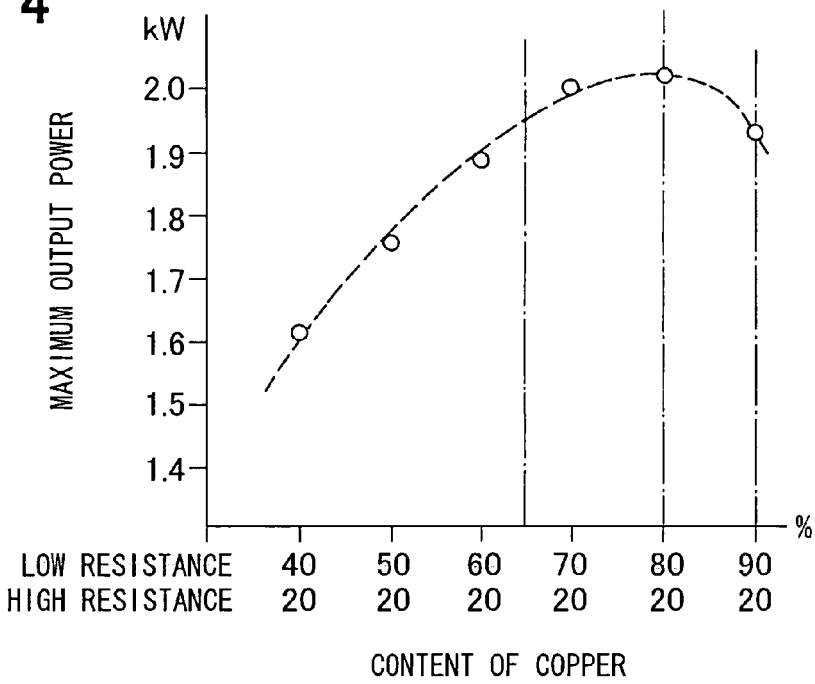
FIG. 4 is a graph showing an output characteristic of the starter motor shown in FIG. 2 relative to contents of brush materials.
FIG. 5 is a table showing a test result of the brush according to the first embodiment versus a prior art brush.

As shown in FIG. 4, the maximum output power of the motor becomes maximum in case the content of a conductive metal such as copper of the low resistance member 11*b* is between 65% and 90% with the content of the conductive metal of the high resistance member being kept 20%.

The brush according to the first embodiment of the invention is much more resistive to a heat shock test and to various conditions during manufacturing processes than the prior art brush, as shown in FIG. 5 in which G indicates good and N indicates no good.

That is, the medium resistance member 11*c* disposed between the high resistance member 11*a* and the low resistance member 11*b* makes it possible to increase the difference in content in a range from 45% up to 70%.

Figure 6:
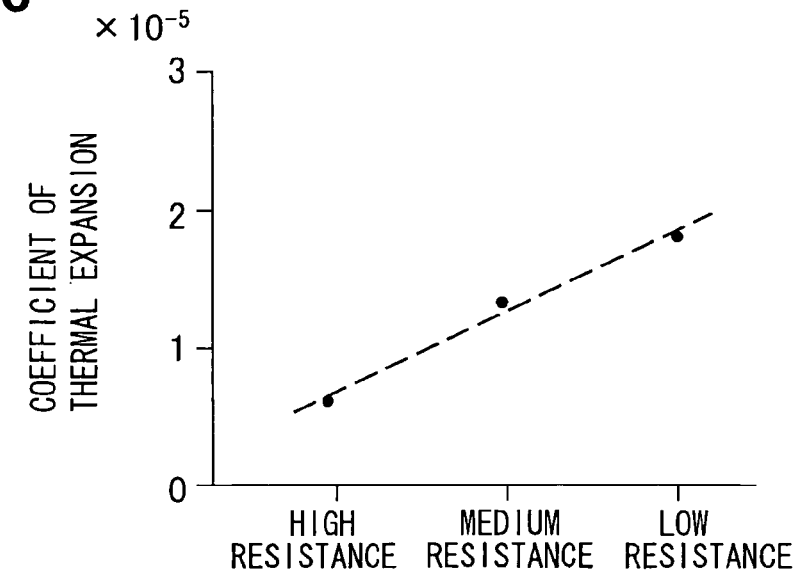
FIG. 6 is a graph showing coefficients of thermal expansion of the resistor materials of the brush according to the first embodiment.

Incidentally, the content of the medium resistance member is changed in a range from 40% to 60% to adjust the thermal expansion coefficient to the middle between the thermal expansion coefficients of the high resistance member and the low resistance member, as shown in FIG. 6.

As the content of the conductive material increases, the lubricity of the brush may decrease. It is effective to increase the lubricity of the brush by adding lubrication material such as molybdenum disulfide or molybdenum tungsten to the low resistance member 11*b* to be higher in content than the high resistance member 11*a* and the medium resistance member 11*c*.

Figure 7:
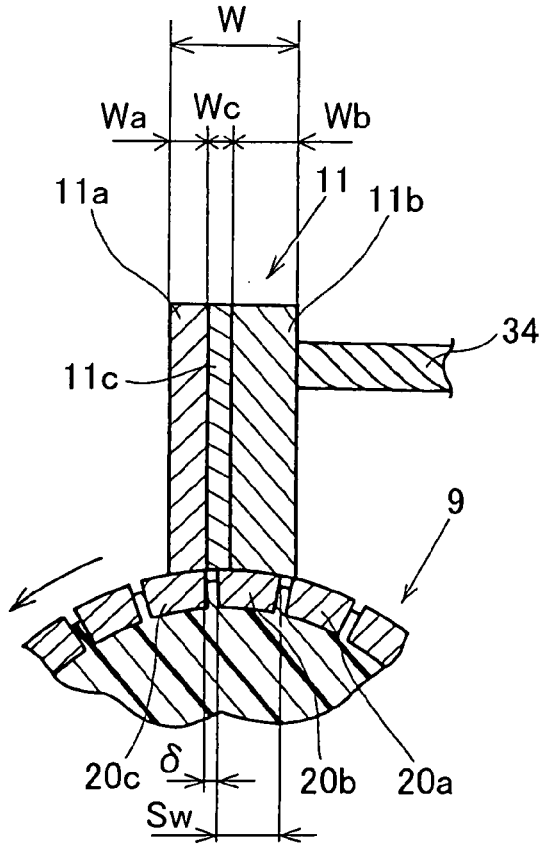
FIG. 7 is a fragmentary cross-sectional view of a brush according to the first embodiment of the invention on a commutator of a starter motor.

A brush according to the second embodiment of the invention will be described with reference to FIG. 7.

The brush 11 is a composite of the high resistance member 11*a*, the low-resistance member 11*b* and the medium resistance member.

It is assumed that: the brush 11 has a total circumferential width W; the high resistance member 11*a* has a circumferential width wa; the low resistance member 11*b* has a circumferential width wb; the medium resistance member has a circumferential width wc; each commutator segment 20 has a circumferential width Sw; and an insulation gap between the commutator segments 20 has a width δ.

Then, the following expressions may be given:

$$W \fallingdotseq wa+Sw+2\cdot\delta \quad (1)$$

$$wb<Sw+2\cdot\delta \quad (2)$$

$$wb>wa \quad (3)$$

$$wb>wc \quad (4)$$

With expressions (1) and (2), there is no possibility that the low resistance member 11*b* solely connects three segments 20*a*, 20*b*, 20*b*. Therefore, current flowing through the low resistance member 11*b* can be limited, so that the life time of the brush can be kept long.

With the expression (3) and (4), the total resistance of the brush 1 can be effectively reduced, so that the output power of the motor can be increased.

The medium resistance member 11*c* can be formed of plural layers each of which has a thermal expansion coefficient different from others. In this case, the layers are arranged so that one of the layers having a lower thermal expansion coefficient comes nearer to the high resistance member 11*a*. The brush according to the invention may be used for various dc motor other than the starter motor.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A brush to be disposed on a commutator of a dc rotary electric machine having a plurality of commutator segments, the brush comprising:

a high resistance member to be positioned at a front side of the commutator in the rotation direction thereof;

a low resistance member to be positioned at a back side in the rotation direction of the commutator;

a medium resistance member disposed between the high resistance member and the low resistance member; wherein:

a difference in content of conductive material between the low resistance member and the high resistance member is in a range from 45% to 70%;

the medium resistance member has a content of conductive material to provide a thermal expansion coefficient between those of the low resistance member and the high resistance member; and the following expression is given between a total circumferential width of W of the brush, a circumferential width wa of the high resistance member, a circumferential width Sw of one commutator segment and a width δ of a gap between the commutator segments:

$$W \fallingdotseq wa+Sw+2\delta.$$

2. The brush as claimed in claim 1, wherein the medium resistance member has a thermal expansion coefficient at a middle between the thermal expansion coefficients of the high resistance member and the low resistance member.

3. The brush as claimed in claim 1 being used for a starter motor for a vehicle.

4. The brush as claimed in claim 1, wherein the medium resistance member has a twisted pigtail wire.

5. A brush to be disposed on a commutator of a dc rotary electric machine having a plurality of commutator segments, the brush comprising:

a high resistance member to be positioned at a front side of the commutator in the rotation direction thereof;

a low resistance member to be positioned at a back side in the rotation direction of the commutator;

a medium resistance member disposed between the high resistance member and the low resistance member; wherein:

a difference in content of conductive material between the low resistance member and the high resistance member is in a range from 45% to 70%;

the medium resistance member has a content of conductive material to provide a thermal expansion coefficient between those of the low resistance member and the high resistance member; and the low resistance member includes a higher content of lubrication material than the high resistance member.

6. The brush as claimed in claim 5, wherein the lubrication material includes one of molybdenum disulfide and molybdenum tungsten.

7. A brush to be disposed on a commutator of a dc rotary electric machine having a plurality of commutator segments, the brush comprising:

a high resistance member to be positioned at a front side of the commutator in the rotation direction thereof;

a low resistance member to be positioned at a back side in the rotation direction of the commutator;

a medium resistance member disposed between the high resistance member and the low resistance member; wherein:

a difference in content of conductive material between the low resistance member and the high resistance member is in a range from 45% to 70%;

the medium resistance member has a content of conductive material to provide a thermal expansion coefficient between those of the low resistance member and the high resistance member; and the following expressions are given between a circumferential width wa of the high resistance member, a circumferential width wb of the low resistance member and a circumferential width wc of the medium resistance member:

$$wb>wa,$$

$$wb>wc.$$

8. A brush to be disposed on a commutator of a dc rotary electric machine having a plurality of commutator segments, the brush comprising:

a high resistance member having a content of conductive material of about 20% to be positioned at a front side of the commutator in the rotation direction of the commutator;

a low resistance member having a content of a conductive material between 65% and 90% to be positioned at a back side in the rotation direction of the commutator;

a medium resistance member disposed between the high resistance member and the low resistance member;

wherein:

the medium resistance member has a content of conductive material to provide a thermal expansion coefficient between those of the low resistance member and the high resistance member; and the low resistance member includes a higher content of lubrication material than the high resistance member.

9. A brush to be disposed on a commutator of a dc rotary electric machine having a plurality of commutator segments, the brush comprising:

a high resistance member having a predetermined content of conductive material to be positioned at a front side of the commutator in the rotation direction of the commutator;

a low resistance member having a content of a conductive material between 65% and 90% to be positioned at a back side in the rotation direction of the commutator;

a medium resistance member disposed between the high resistance member and the low resistance member;

wherein:

the predetermined content makes a difference in content of conductive material between the low resistance member and the high resistance member in a range from 45% to 70%;

the medium resistance member has a content of conductive material to provide a thermal expansion coefficient between those of the low resistance member and the high resistance member; and the low resistance member includes a higher content of lubrication material than the high resistance member.

* * * * *